US005338921A

United States Patent [19]

Maheux et al.

[11] Patent Number: 5,338,921

[45] Date of Patent: Aug. 16, 1994

[54] METHOD OF DISTRIBUTING HEAT IN FOOD CONTAINERS ADAPTED FOR MICROWAVE COOKING AND NOVEL CONTAINER STRUCTURE

[75] Inventors: David Maheux, Laconia; Robert Tomich, Concord, both of N.H.

[73] Assignee: Universal Packaging Corporation, Concord, N.H.

[21] Appl. No.: 17,808

[22] Filed: Feb. 16, 1993

[51] Int. Cl.[5] ..... H05B 6/80

[52] U.S. Cl. ..... 219/730; 219/759; 426/234; 426/107; 99/DIG. 14; 156/272.2

[58] Field of Search ..... 219/10.55 E, 10.55 F, 219/728, 730, 759; 426/107, 109, 111, 113, 234, 241, 243; 99/DIG. 14; 156/272.2, 158, 163, 164

[56] References Cited

U.S. PATENT DOCUMENTS

| | | | |
|---|---|---|---|
| 4,316,070 | 2/1982 | Prosise et al. | 219/10.55 E |
| 4,820,893 | 4/1989 | Mode | 219/10.55 E |
| 4,851,632 | 7/1989 | Kaliski | 219/10.55 E |
| 4,894,247 | 1/1990 | Fong | 426/107 |
| 4,911,938 | 3/1990 | Fisher et al. | 426/107 |
| 4,950,859 | 8/1990 | Anderson | 219/10.55 E |
| 5,081,330 | 1/1992 | Brandberg | 219/10.55 F |

*Primary Examiner*—Philip H. Leung
*Attorney, Agent, or Firm*—Rines and Rines

[57] ABSTRACT

An improved technique for uniformly distributing crisping or browning heat supplementation in disposable paper food carton or containers and the like used for microwave cooking, in which a metallized susceptor film is employed mounted to but intermediately spaced from the adjacent inner wall of the container to define and seal an air pocket which, in heating, improves the uniformity of the browning result through convection into air pocket and responsive flexing of the film.

22 Claims, 3 Drawing Sheets

SUSCEPTOR LAMINATED TO CARTON

SUSCEPTOR PATTERN BONDED TO CARTON

Figure 1:
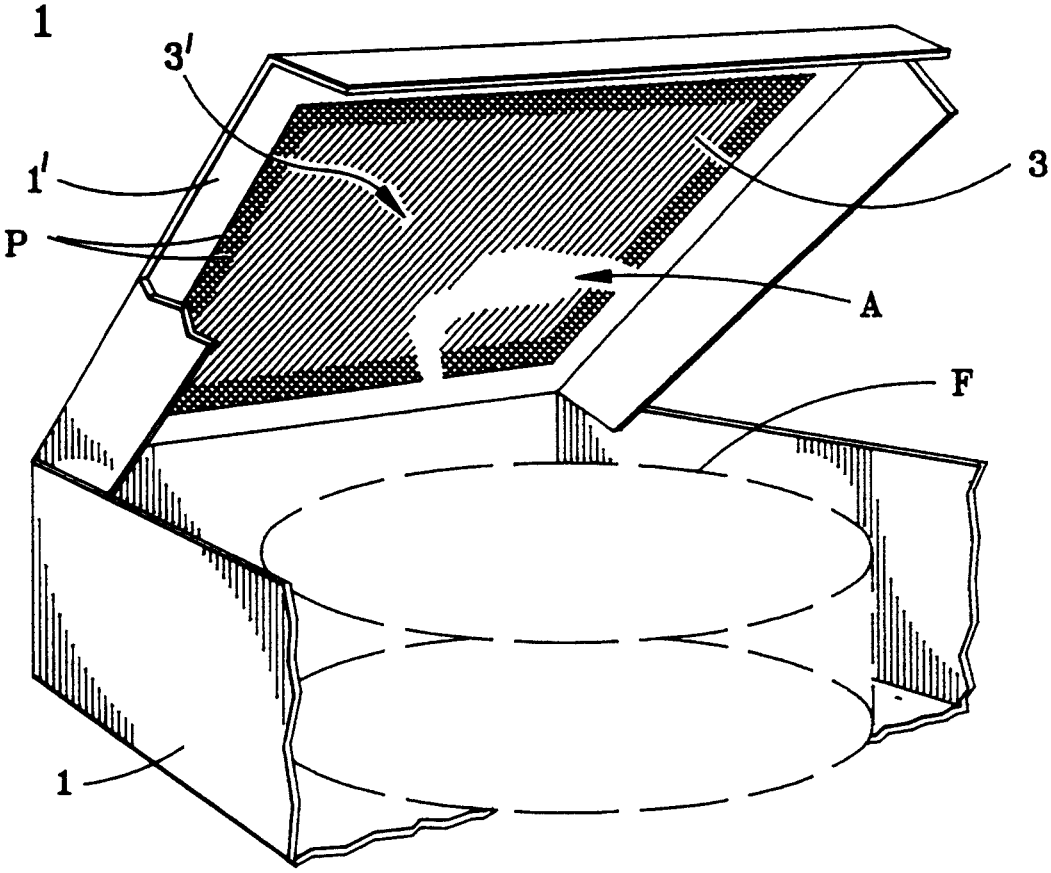

METHOD OF DISTRIBUTING HEAT IN FOOD CONTAINERS ADAPTED FOR MICROWAVE COOKING AND NOVEL CONTAINER STRUCTURE

The present invention relates to the microwave cooking of foods in primarily disposable food containers or receptacles, as of the paper carton type, and the like; being more particularly directed to the incorporation in the container of thin metallized plastic or foil films or the like, carried along one or more inner surfaces of the disposable container and adapted to aid in the more complete and/or selective heating, browning and/or crisping of the food through supplemental heat generated as a result of microwave interaction with such metallized plastic film or the like.

BACKGROUND

It has previously been proposed, as in U.S. Pat. No. 4,641,005, to increase the browning or crisping of the exterior of food as packaged in a disposable coated cardboard paper food container, by laminating to the surfaces of the container that abut the food packaged therein, a metallized electrically conductive layer, such as vapor-deposition metallized polyester or other thin plastic sheet and the like. The interaction of the microwave energy with the composite of the metallized plastic film or sheet causes additional heating adjacent the abutting exposed surface of the food which has been found to aid in browning and making the food more cosmetically compatible with other types of oven cooking, as well as better tasting.

Other techniques, including for localizing the supplemental heating are described, for example, in U.S. Pat. Nos. 4,735,513 and 4,878,765.

In some areas, the technique above described has attained the descriptor of a "susceptor film," usually constructed of polyester film, such as 46-gauge Dupont "Mylar" with a control density vapor-deposited aluminum coating measuring about 0.25 optical density or 65–100 ohms per square in electrical resistance. Such metallized films are then laminated to either paper or paperboard, as in the container or receptacle construction of disposable or foldable box containers. These have proved quite satisfactory for the microwave cooking of foods like popcorn, but have required techniques for overcoming seriously uneven and uncontrolled heating that have rendered such devices less than satisfactory for producing reliably reproducible results with other foods. Such susceptor films, as above stated, however, are now being used by the food industry for such purposes as browning and crisping foods, operating, however, as relatively uncontrolled resistive heaters because of their construction and inherent limitations of the conductive electrode and substrate structures.

To mitigate against the deleterious effects of localized hot zones and the like, techniques have been proposed for demetallizing, as by etching, different areas to reduce the generated heat and/or eliminate it in the specified zones, thereby to create more uniform browning or crisping by such patterned demetallization in the composite of the plastic film with its metallized layer. Such techniques are described, for example, in U.S. Pat. Nos. 4,865,921 and 4,959,120. The use of outer layers of lacquer to be printed in patterned heat zones has also been proposed, as in U.S. Pat. No. 4,963,424.

Another approach at patterned metalization for temperature control using electrodeposition techniques is described in U.S. Pat. No. 4,962,293. A foil grid used in association with a susceptor film has also been proposed in U.S. Pat. No. 4,927,991.

More recently, other types of membrane susceptor films have been proposed, embodying two metallized coatings in which at least one electrode has been selected for its microwave absorbing qualities and at least another metallized coating selected for its capability for controlling the level of transmitted energy—such being offered under the trademarks "Accucrisp," by A.D. Tech Advanced Dielectric Technologies, Inc., of Tauton, Mass.

Up until the present time, however, it has been considered essential to laminate and secure throughout its surface the metallized plastic film or other layered laminated composite of metallic layer or film with polyester or other suitable baking sheet and high-temperature thin plastic or paper, laminated as an integral unit throughout the paper or other wall of the container, carton or receptacle for the food; and laminating techniques have been developed for insuring such coextensive support of the metallized film by the carton or container wall and the lamination into such integral structure.

Underlying the present invention, however, is the discovery that the non-uniformity of microwave interaction with the metallized layer (and thus the incomplete browning or crisping heating over the layer) appears to result from this integration or total lamination of the film against the carton walls.

The present invention, to the contrary, steers away from this standard practice of lamination integration by bonding the film to the carton wall or other container at restricted and minimal regions only, such as the peripheral border of the metallized plastic film, thus securing the same to the container wall but in such a way as to incorporate an air pocket space between a substantial unlaminated major area of the container wall, over which the film is free to flex in response to hot air convection effects within the air pocket.

OBJECT OF INVENTION

It is accordingly an object of the present invention to provide a new and improved method of more uniformly distributing the heat generated by microwave interaction with thin flexible metallized plastic films and other susceptor films or layers carried on the walls of disposable containers for food and the like that are to be exposed to microwave energy, as in an oven.

A further object is to provide novel disposable containers and the like for food to be exposed to microwave energy embodying new and improved flexible metallized films attached to the container but so as to remain in major part separated from and loosely flexible over the container wall(s) with an air pocket(s) therebetween, to enable such improvement in more uniform distribution of heat.

Other and further objects will be explained hereinafter and are more particularly delineated in the appended claims.

SUMMARY

In summary, however, from one of its viewpoints, the invention embraces a method of more uniformly distributing the heat generated by microwave interaction with a thin, flexible and non-self-supporting metallized film carried adjacent and extending over a substantial area of an inner wall of a disposable container for food to be exposed to microwave energy, as in an oven, that comprises, adhering the periphery of said metallized film to said wall, peripherally to mount the film with substantially its major intermediate area loosely and flexibly spaced from said wall to define an air pocket between the film and said wall, and exposing the container with food therein to microwave energy simultaneously to heat the air in said pocket and cause convection spreading of the microwave-interacting heat generated along the metallized film, as it flexes in response to such convection, more uniformly to brown the food in the container.

Suitable disposable foldable wall containers embodying the construction specified above are also disclosed with preferred and best mode designs and embodiments later presented, and including preferred techniques for attachment of the metallized film to container surfaces.

DRAWINGS

Figure 2:
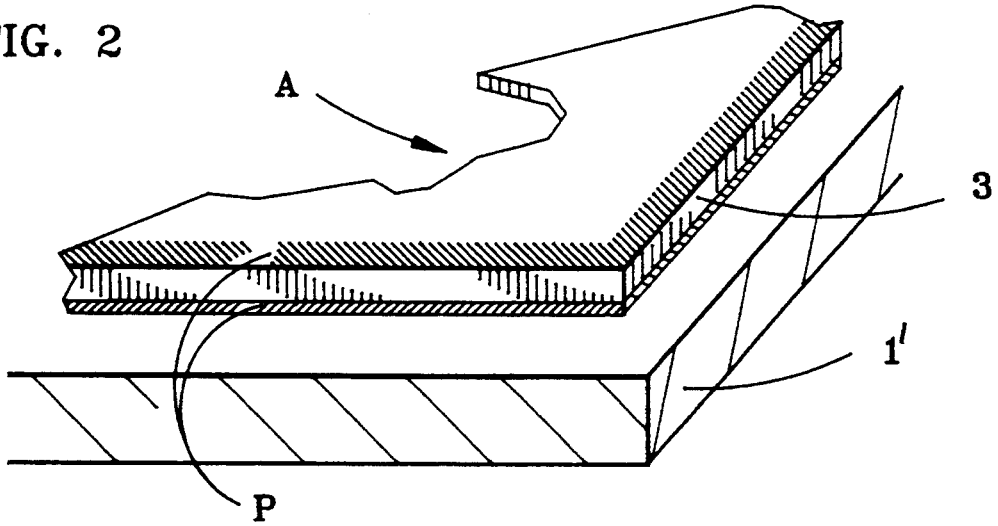
Figure 3A:
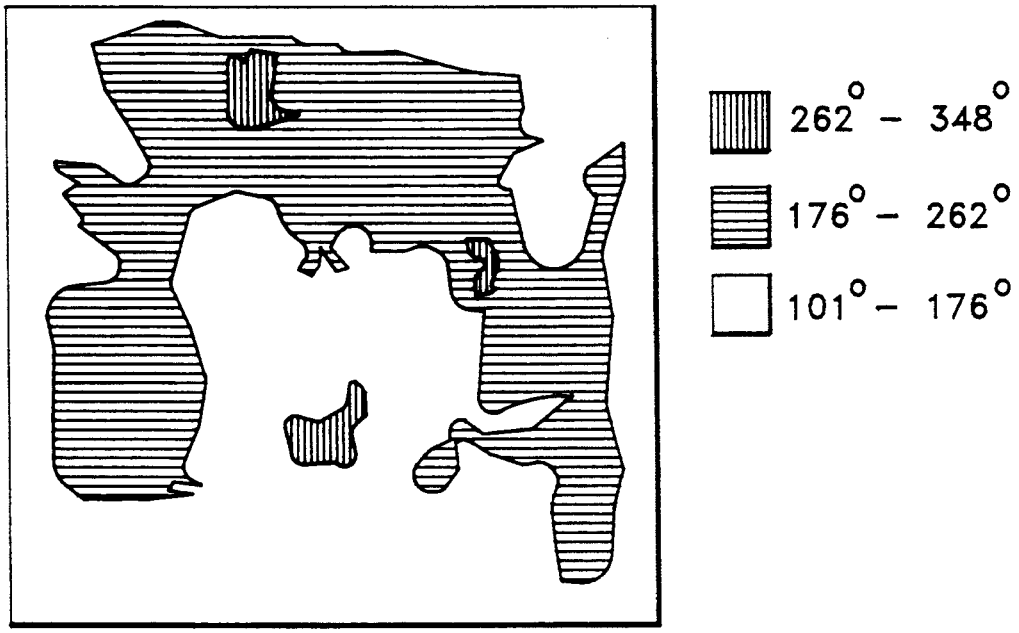
Figure 3B:
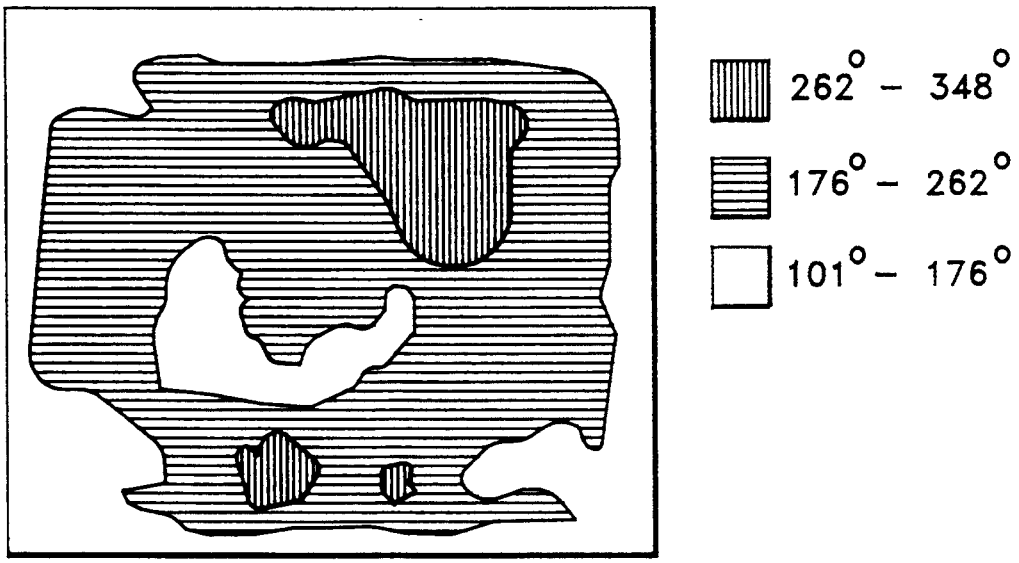

The invention will now be described in connection with the accompanying drawings, FIG. 1 of which is an isometric view showing foldable paper board carton or container and employing along the inner surface of its upper lid or cover wall, a heat-distributing metallized film supported in accordance with the preferred embodiment of the present invention;

FIG. 2 is a fragmentary view, upon an enlarged scale, showing the sealed air pocket between the container wall and the metal layer;

FIGS. 3A and 3B are thermal area diagrams respectively comparing the heat distribution effects of the same metallized thin plastic film for the conventional prior art construction with the film totally laminated to the container wall or surface support, as with the peripheral securing only, in accordance with the invention, producing significant improvement attained by the action of the air spaced (behind the loosely mounted film, flexibly spaced) from the wall of the carton; and.

Figure 4:
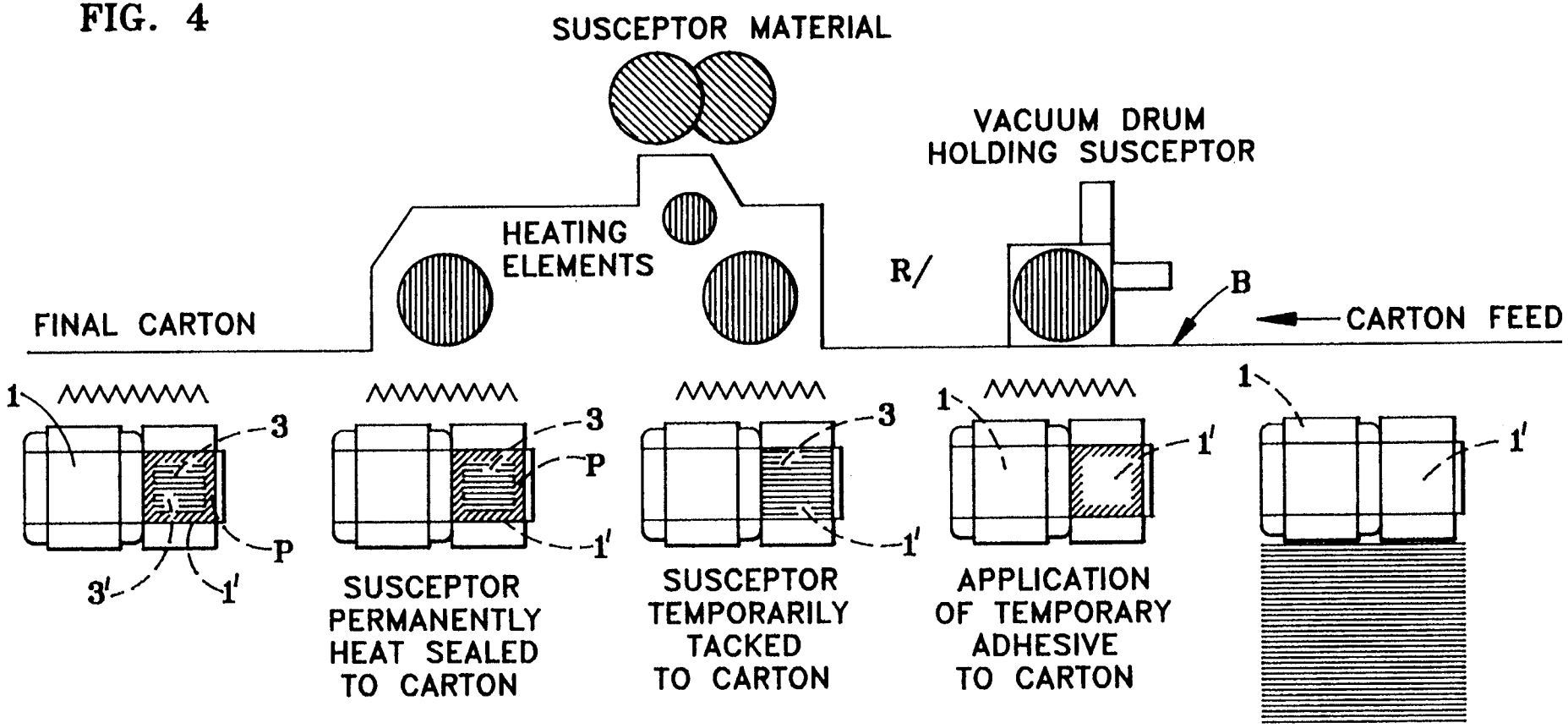

FIG. 4 is a diagram of a preferred method of providing the metallized plastic film attachments to the container wall(s) in accordance with the invention.

Referring to FIG. 1, a foldable carton, receptable or container as of coated paper board or the like, is shown generally at 1, having a lid or cover wall 1', the inner wall surface of which is shown provided with a thin, flexible non-self-supporting metallized plastic film 3, such as may be described, for example, in the above-mentioned patents, and in particular U.S. Pat. No. 4,641,005 and the like. Specifically, the thin plastic sheet of the composite metallized film 3, may be an insulating polyester film, or carrier sheet, as of the dimensions previously discussed, carrying an aluminum or other metal vapor-deposition or other metal surface or surfaces. Other types of thin metal foil, coatings or other conductive surfaces may also be employed, and of other metals, including thin steel films. Metal layers or foils, either on their own or with backing sheet may also be employed, all such being intended to be embraced herein by the phrase "metallized film,"

In all cases, however, such metallized film is not laminated to the inner surface of the upper lid of the carton 1', throughout its extent, as in prior systems, but is only adhered, secured or bonded on a limited peripheral margin or border region, illustrated as of rectangular configuration at 2 about the sheet 3. Preferably, as later explained, the adhering is effected by heat sealing or bonding that margin or border in a peripheral strip (about, say, ¼ inch wide), leaving a loose and flexible substantially total or major inner intermediate area 3' of the film 3 not laminated or otherwise connected to the wall 1', but intermediately separated or spaced therefrom by an included and sealed air pocket trapped during the peripheral adhesion at P, the air pocket being shown in the breakaway section at A, in both FIGS. 1 and 2.

With such construction, it has been discovered that, as the carton lid or cover 1' is closed over the contained food F, and the carton 1 is inserted into the microwave oven, such is exposed to microwave cooking, and the metallized portion of the film 3 becomes heated, as in prior susceptor films of this character. But, in addition, however, since the film is not laminated to the wall surface of the carton 1', the sealed air space A included behind it, becomes simultaneously heated and creates convection currents, circulating in the air space. In view of the flexible and loose nature of the unsupported intermediate substantially total extent 3' of the film 3, the hot convection currents induce movement of the loose film. This phenomenon has been discovered to result in a significant improvement in the spreading and uniformity of the heat radiated back to the adjacent exposed portion of the food F facing the metallized susceptor film, and has been found significantly to improve the quality of the supplemental browning or crisping as well as the uniformity of cooked appearances.

Referring to FIG. 3(A), a metallized film of the before-mentioned A.D. Tech Type "Accu-crisp 1000" was tested with a Danish pastry under conditions of the prior art total lamination of the film to the inside surface of the cover wall of the paperboard container. As will be observed, the total central and lower portions of the heat distribution did now exceed the 101°–176° range.

FIG. 3(B), on the other hand, shows the same metallized plastic film supported marginally only, as shown in FIGS. 1 and 2, with the resulting marked improvement of the distributing action in the heated air space A behind the convection-current responsive flexibly moving surface of the metallized susceptor film 3. FIG. 3(B) demonstrates the significant improvement in spreading and uniformity of the heat generated and reflected back to the food by the susceptor film 3, with over about 80% of the surface now in the 176°–348° range, and the lower portions now well heated.

A convenient apparatus for effecting the preferred heat sealing is schematically shown in FIG. 4 wherein a belt B carries the successive paperboard carton or container blanks 1, with inner lid surfaces 1' of successive carton blanks exposed, to a metallized layer susceptor material vacuum drum holding region R there-above.

A temporary peripheral margin or border of adhesive is applied at R to the inner walls of the successive carton lids 1; following which, the susceptor material is overlaid and temporarily tacked to such adhesive margin at $R_2$; and then, the margin of the susceptor is heat-sealed or bonded at P by appropriately shaped heat-seal elements, shown at $R_3$ over the adhesive border, thereby to form the structure of FIGS. 1 and 2.

While the preferred heat-sealing is illustrated, it should be stressed that it has the further advantage that the very process of heat-sealing modifies (destroys) the properties of the plastic and renders such non-heatable in the marginal regions P, which may be external to the food F, beneficially limiting waste heat thereat and confining the heating and its distribution only to the area $3^1$ adjacent the food product. This margin P may, if desired, be slightly inwardly offset from the actual edges of the sheet 3 for similar reasons.

While heat-sealing is shown in the rectangular peripheral border pattern P, clearly other patterns of limited-region sealing may be employed. For example, the corner sector of FIG. 2 may be sealed along the hypotenuse to form a corner pocket, and adjacent additional such pockets may be similarly formed over the film; always, however, leaving major air space pockets. A between the sheet 3 and the wall 1' and major preferably totally sealed-in air spaces for best results. Where the metallized film is in the form of the before-described plastic sheet with its metallized layer deposit, the plastic and the carton wall will serve further to provide an insulated sealed air space. In some instances, furthermore, as previously intimated, instead of directly sealing the periphery to the carton wall by the preferred heat-sealing technique above described, the metallized film 3 may be first laminated with a paper or other flexible insulating backing or backup carrier sheet. The peripheral border of such composite metallized film and backing sheet (now together representing the showing 3 in FIGS. 1 and 2), may be provided with adhesive strips that will adhere to the carton wall 1', providing the air space between that wall and the backed metal layer, the metal surface of which is adjacent to the food.

While the invention has been described with reference to susceptor layers used on the inner cover or lid wall of the carton, clearly the susceptor may be applied to other of the carton walls (or even portions thereof) where the supplemental heating effects of the invention are desired.

Further modifications will occur to those skilled in this art and such are considered to fall within the spirit and scope of the invention as defined in the appended claims.

What is claimed is:

1. A method of uniformly distributing the heat generated by microwave interaction with a thin, flexible and non-self-supporting metallized film carried adjacent and co-extending over a substantial area of an inner wall of a disposable container for food to be exposed to microwave energy, as in an oven, that comprises, adhering the periphery of said metallized film to said wall peripherally to mount the film with substantially its major intermediate area loosely and flexibly spaced from said wall to define an air pocket between the film and said wall, and exposing the container with food therein to microwave-interacting heat generated along the metallized film, as it flexes in response to such convection, more uniformly to heat, crisp and/or brown the food in the container.

2. A method as claimed in claim 1 and in which the adhering is effected by heat-sealing a border of the film to the container wall.

3. A method as claimed in claim 1 and in which the adhering is effected by adhesively securing a border of the film to the container wall.

4. A method as claimed in claim 3 and in which the metallized film is laminated to a backing sheet and the border of the backing sheet is adhesively secured to the container wall.

5. A method as claimed in claim 1 and in which the metallized film comprises a plastic sheet having a metallized layer.

6. A method as claimed in claim 1 and in which the metallized film comprises a composite of a metal layer laminated to a backing sheet.

7. A method as claimed in claim 1 and in which the air pocket is totally sealed between the film and said wall.

8. A method as claimed in claim 1 and in which the metallized film comprises an insulating carrier that, together with the container wall, insulates the sealed air pocket.

9. A method of uniformly distributing the heat generated by microwave interaction with a thin, flexible and non-self-supporting metallized film carried adjacent and co-extending over a substantial area of an inner wall of a disposable container for food to be exposed to microwave energy, as in an oven, that comprises, adhering a limited region of said metallized film to said wall to mount the film with substantially its major intermediate area loosely and flexibly spaced from said wall to define an air pocket between the film and said wall, and exposing the container with food therein to microwave-interacting heat generated along the metallized film, as it flexes in responses to such convection, more uniformly to heat, crisp and/or brown the food in the container.

10. A method as claimed in claim 9 and in which said adhering is effected over a plurality of limited regions to provide a plurality of said air pockets over the film.

11. A method of uniformly distributing the heat generated by microwave interaction with a thin, flexible metallized plastic film carried along a co-extensive wall of a container for food to be exposed to microwave energy, as in a oven, that comprises, adhering said metallized plastic film to only limited regions of said wall to mount the film thereon loosely and flexibly with intermediate air pocket (s) between the adhering regions of the film and said wall, and exposing the container with food therein to microwave energy simultaneously to heat the air in said pocket(s) and cause convection-spreading of the microwave-interacting heat generated along the metallized film, as it flexes in response to such convection, more uniformly to heat, crisp and/or brown the food.

12. In a container for food to be exposed to microwave energy, as in an oven, the combination of a thin, flexible metallized plastic film; a container wall co-extensive with the film throughout its extent and means for adhering the periphery of the film to and closely adjacent the container wall while maintaining substantially the major intermediate area of the film loosely and flexibly spaced from though adjacent said wall throughout the film to define an included air pocket between the film and said wall.

13. A container as claimed in claim 12 and in which the adhering means comprises a border heat-sealed to said wall.

14. A container as claimed in claim 13 and in which said border is offset from the edges of the sheet.

15. A container as claimed in claim 12 and in which the adhering means comprises an adhesive border.

16. A container as claimed in claim 15 and in which the film is laminated to a backing sheet and the adhesive border is provided peripherally of the backing sheet.

17. A container as claimed in claim 12 and in which the container walls are formed of coated paper stock, the plastic film is a polyester sheet, and the metallizing of the film is by one or more thin metal layer(s).

18. A container as claimed in claim 12 and in which the said container wall is the inner wall of the container cover.

19. A container as claimed in claim 18 and in which the area of the metallized film is a substantial portion of the area of the said inner wall of the container cover and corresponds to the top surface of the food-to-be-cooked.

20. In a disposable foldable-wall container for food to be exposed to microwave energy, as in an oven, the combination of a thin, flexible metallized layer, a container wall co-extensive with and adjacent the layer throughout its extent, and means adhering limited regions only of the layer to the inner surface of the container wall, while maintaining the substantially major intermediate area of the layer loosely and flexible spaced from though adjacent said wall throughout the layer to define an included air pocket(s) between the layer and said wall.

21. A method of forming a disposable foldable-wall container for food to be exposed to microwave energy, as in an oven, that comprises, forming paper stock container blanks and feeding the same successively along a belt with the portion of each blank forming an inner surface of a container wall and successively passing a predetermined region; feeding a thin, flexible, non-self-supporting metallized film to a vacuum-holding station disposed above said predetermined region; providing heatable means shaped to define the periphery of the successive container walls of successive container blanks passing said region; overlaying said successive sections of the film upon the corresponding inner surfaces of the container walls, while activating said heatable means to heat-seal the film sections along their peripheries to the corresponding inner walls of the successive container blanks to define and seal air pockets between the respective film sections and the corresponding container blank walls.

22. A method as claimed in claim 21 and in which a peripheral adhesive boarder is applied to the container blank inner wall before heat-sealing the film to such border.

* * * * *